US007866168B2

(12) United States Patent
Gordon et al.

(10) Patent No.: US 7,866,168 B2
(45) **Date of Patent: *Jan. 11, 2011**

(54) HEAT PUMP WATER HEATER

(75) Inventors: Michael W. Gordon, Grand Rapids, MI (US); Eugene L. West, Grand Rapids, MI (US)

(73) Assignee: Bradford White Corporation, Ambler, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/970,822

(22) Filed: Jan. 8, 2008

(65) Prior Publication Data

US 2008/0104986 A1 May 8, 2008

Related U.S. Application Data

(63) Continuation of application No. 11/205,446, filed on Aug. 17, 2005, now Pat. No. 7,334,419.

(51) Int. Cl.
*F25B 7/00* (2006.01)

(52) U.S. Cl. ..... 62/79; 62/238.7

(58) Field of Classification Search ..... 62/79, 62/160, 180, 184, 238.6, 430, 238.7, 324.1; 237/2 B See application file for complete search history.

(56) References Cited

U.S. PATENT DOCUMENTS 2,095,017 A * 10/1937 Wilkes et al. ..... 122/15.1
2,516,094 A 7/1950 Ruff
2,575,325 A 11/1951 Ambrose et al.
2,696,085 A 12/1954 Ruff
2,716,866 A * 9/1955 Silva ..... 62/196.4
3,854,454 A * 12/1974 Lazaridis ..... 122/33
4,320,630 A 3/1982 Uselton et al.
4,330,309 A 5/1982 Robinson
4,386,500 A 6/1983 Sigafoose
4,492,091 A 1/1985 Whitwell et al.
4,513,585 A * 4/1985 Maisonneuve ..... 62/238.6
4,665,712 A 5/1987 Gehring et al.
4,823,557 A * 4/1989 Bottum et al. ..... 62/238.6
4,940,042 A * 7/1990 Moore et al. ..... 122/18.2
5,012,793 A * 5/1991 Guzorek ..... 126/85 B
5,020,512 A 6/1991 Vago et al.
5,220,807 A * 6/1993 Bourne et al. ..... 62/238.6

(Continued)

FOREIGN PATENT DOCUMENTS

JP 2000-329399 A * 11/2000

OTHER PUBLICATIONS

Abstract of JP 2000-329399 A to Katsumi et al.*

(Continued)

*Primary Examiner*—Mohammad M Ali
(74) *Attorney, Agent, or Firm*—RatnerPrestia

(57) ABSTRACT

A heat pump water heater system including a water storage tank and a heat exchange system. The heat exchange system includes a heat absorber positioned below the water storage tank and a heat rejecter in fluid communication with the heat absorber and positioned within the water storage tank. The heat absorber is configured to transfer heat to fluid in the heat exchange system, and the heat rejecter is configured to transfer heat from fluid in the heat exchange system to the water in the water storage tank.

16 Claims, 7 Drawing Sheets

U.S. PATENT DOCUMENTS

| | | | | |
|---|---|---|---|---|
| 5,305,614 | A | 4/1994 | Gilles | |
| 5,573,182 | A | 11/1996 | Gannaway et al. | |
| 5,758,820 | A | 6/1998 | Celorier et al. | |
| 5,816,199 | A | 10/1998 | Khizh et al. | |
| 5,906,109 | A | 5/1999 | Dieckmann et al. | |
| 6,098,414 | A * | 8/2000 | Boxum | 62/141 |
| 6,233,958 | B1 | 5/2001 | Mei et al. | |
| 6,698,386 | B1 * | 3/2004 | Hoffman | 122/14.31 |
| 7,013,841 | B1 * | 3/2006 | Boros et al. | 122/19.2 |

OTHER PUBLICATIONS

Translation to JP 2000-329399 A to Katsumi et al.*

Federal Technology Alert, *Residential Heat Pump Water Heaters: Energy Saving Alternative for Home Hot Water*, U.S. Department of Energy, Sep. 1995. Available at www.eere.energy.gov.

* cited by examiner

HEAT PUMP WATER HEATER

CROSS-REFERENCE TO RELATED APPLICATIONS

This continuation application is related to and claims the benefit of co-pending of U.S. patent application Ser. No. 11/205,446 entitled "HEAT PUMP WATER HEATER" and filed on Aug. 17, 2005, which is incorporated herein by reference in its entirety.

FIELD OF THE INVENTION

The present invention relates generally to a device and method for heating water in a water storage tank and heating or cooling ambient air, and more specifically, to heat pump water heaters.

BACKGROUND OF THE INVENTION

Heat pump water heaters provide an energy and cost-efficient way to heat water with electricity. These types of heaters typically provide the same amount of hot water as electric resistance water heaters, but do so at about one-half to one-third the energy cost. Heat pump water heaters may also have the added benefit of providing air-conditioning as a by-product of water heating.

Heat pump water heaters work by transferring heat, not by generating heat. Typically, a heat pump water heater uses a standard vapor refrigeration compression cycle in reverse. In this manner, a heat pump water heater uses a closed-loop heat exchange circuit to absorb heat from a source (such as air in a room) and transfers the heat to a heat sink (such as water in a water storage tank). The energy consumed in a heat pump water heater system is the energy to run a compressor to circulate the refrigerant in the heat exchange circuit.

One drawback to heat pump water heaters is their installation costs. Because heat pump water heaters include the piping and ventilation of air and water, installation costs can be more expensive than conventional water heaters. Moreover, the components of the heat pump water heaters add to the cost of manufacturing the device because heat pump water heaters typically require more parts than a standard water heater or heat pump.

What is needed therefore is a heat pump water heater design and construction that maintains the benefits of a heat pump water heater but decreases the manufacturing and installation costs.

SUMMARY OF THE INVENTION

According to an exemplary embodiment, a heat pump water heater system has a water storage tank and a heat exchange system. The heat exchange system includes a heat absorber positioned below the water storage tank and a heat rejecter region in fluid communication with the heat absorber and positioned within the water storage tank. The heat absorber is configured to transfer heat to fluid in the heat exchange system, and the heat rejecter region is configured to transfer heat from fluid in the heat exchange system to water in the water storage tank.

According to another exemplary embodiment, a heat pump water heater includes a water storage tank positioned in an upper portion of the heat pump water heater and a heat exchange system. The heat absorber is positioned in a lower portion of the heat pump water heater below the water storage tank. The heat pump water heater defines an air supply passage upstream of the heat absorber and has an inlet positioned above the lower portion of the heat pump water heater.

A method of manufacturing a heat pump water heater according to an exemplary embodiment of the present invention includes positioning a water storage tank within an upper portion of a jacket of the heat pump water heater, positioning a heat absorber in a lower portion of the jacket below the water storage tank, positioning a heat rejecter region within the water storage tank, and coupling the heat absorber and heater rejecter to form a heat exchange system.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
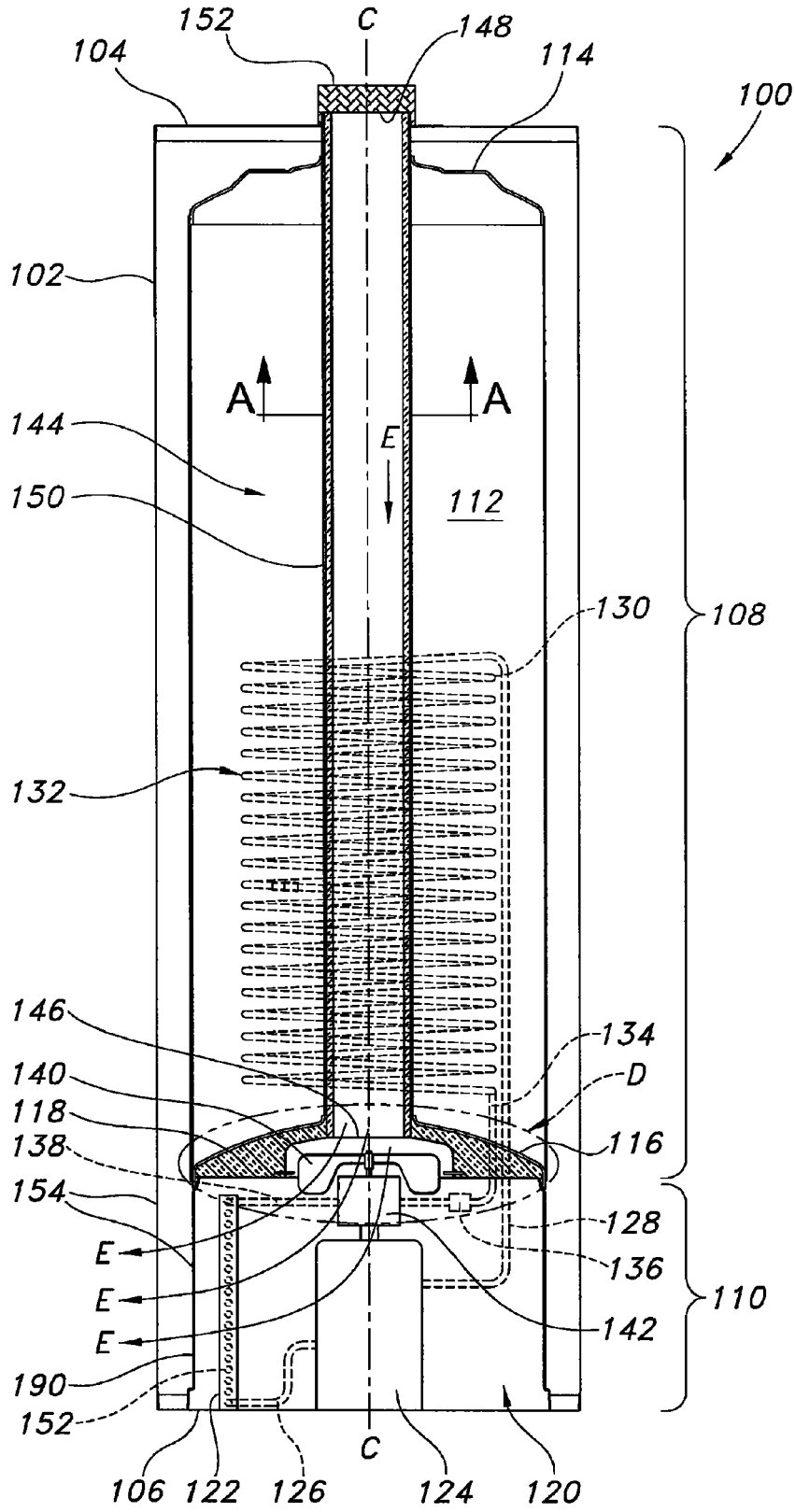
FIG. 1 illustrates a heat pump water heater according to an exemplary embodiment of the present invention.

Although the invention is illustrated and described herein with reference to specific embodiments, the invention is not intended to be limited to the details shown. Rather, various modifications may be made in the details within the scope and range of equivalents of the claims and without departing from the invention.

This invention, according to one embodiment, brings about a more efficient means to heat water because it transfers heat from one medium (e.g., an air source) to another medium (e.g., stored water). This is an advantageous way to heat water because it is generally more efficient to transfer heat than it is to create heat. This transfer of heat is optionally accomplished by the use of the thermodynamic principles of the vapor compression refrigeration cycle.

A vapor compression system designed to utilize these thermodynamic principles typically consists of a compressor that moves a heated fluid from a heat absorber section of the system to a heat rejecter section of the system where the transfer of heat to the stored water is accomplished. The heat absorber, the heat rejecter, and the compressor are joined into a system by the use of interconnecting fluid-containing lines.

Generally, and according to one exemplary embodiment of the invention, a heat pump water heater system has a water storage tank and a heat exchange system. The heat exchange system includes a heat absorber positioned below the water storage tank and a heat rejecter that is positioned within the water storage tank. The heat absorber is configured to absorb heat from an air source. A compressor transports this heat to the heat rejecter where the heat rejecter transfers the heat to the stored water.

Referring generally to the figures, a heat pump water heater system 100, 500, 600, 700 has a water storage tank 112, 516, 616, 716 and a heat exchange system 120. The heat exchange system 120 includes a heat absorber 122, 222, 522, 622, 722 positioned below the water storage tank 112, 516, 616, 716 and a heat rejecter 132, 532, 632, 732 in fluid communication with the heat absorber 122, 222, 522, 622, 722 and positioned within the water storage tank 112, 516, 616, 716. The heat absorber 122, 222, 522, 622, 722 is configured to transfer heat to fluid in the heat exchange system 120, and the heat rejecter 132, 532, 632, 732 is configured to transfer heat from fluid in the heat exchange system 120 to water in the water storage tank 112, 516, 616, 716.

According to another exemplary embodiment, a heat pump water heater 100, 500, 600, 700 includes a water storage tank 112, 516, 616, 716 positioned in an upper portion 108 of the heat pump water heater 100, 500, 600, 700 and a heat exchange system 120. The heat absorber 122, 222, 522, 622, 722 is positioned in a lower portion 110 of the heat pump water heater 100, 500, 600, 700 below the water storage tank 112, 516, 616, 716. The heat pump water heater 100, 500, 600, 700 defines an air supply passage such as a flue 144, 444, 544, 644, 744 upstream of the heat absorber 122, 222, 522, 622, 722 and has an inlet 148, 572, 780 positioned above the lower portion 110 of the heat pump water heater 100, 500, 600, 700.

According to yet a further embodiment, the water storage tank 112, 516, 616, 716 has an interior portion with a central axis C. The air supply passage 144, 444, 544, 744 extends through the interior of and along the central axis C of the water storage tank 112, 516, 616, 716. At least one coil of the heat transfer region 132, 532, 632, 732 is disposed around the air supply passage 144, 444, 544, 744.

A method of manufacturing a heat pump water heater 100, 500, 600, 700 according to an exemplary embodiment of the present invention includes positioning a water storage tank 112, 516, 616, 716 within an upper portion 108 of an outer jacket 102, 702 of the heat pump water heater 100, 500, 600, 700; positioning a heat absorber 122, 222, 522, 622, 722 in a lower portion 110 of the jacket 102, 702 below the water storage tank 112, 516, 616, 716; positioning a rejecter 132, 532, 632, 732 within the water storage tank 112, 516, 616, 716; and coupling the heat absorber 122, 222, 522, 622, 722 and heater rejecter 132, 532, 632, 732 to form a heat exchange circuit 120.

Referring now to each of the embodiments illustrated in the drawing, FIG. 1 illustrates heat pump water heater system 100 according to an embodiment of the present invention. Heat pump water heater system 100 is defined by an outer jacket 102 having a heat pump water heater top 104 and a heat pump water heater bottom 106. Outer jacket 102 defines an upper portion 108 and a lower portion 110.

Disposed in upper portion 108 is a water storage tank 112. Water storage tank 112 has a top 114 and a base 116. According to the embodiment illustrated in FIG. 1, base 116 is substantially concave in shape and is filled with base insulation 118.

Disposed in lower portion 110 is a portion of a heat exchange system 120. Heat exchange system 120 is comprised of a heat absorber 122 connected to a compressor 124 by way of a first fluid line 126. A second fluid line 128 travels from compressor 124 disposed in lower portion 110 into water storage tank 112 in upper portion 108. Second fluid line 128 passes into the interior of water storage tank 112 and forms a plurality of coils 130 as part of a heat rejecter 132. From heat rejecter 132, a third fluid line 134 passes from the interior of water storage tank 112 in upper portion 108 to lower portion 110. In lower portion 108, third fluid line 134 connects to an expansion valve 136. From expansion valve 136, a fourth fluid line 138 returns fluid back to heat absorber 122.

As shown in the embodiment of FIG. 1, a fan 140 has a motor 142 and is located on top of compressor 124. Fan 140 is mounted in such a way that it is positioned where upper portion 108 meets lower portion 110. Because water storage tank base 116 is concave, base insulation 118 serves to insulate water storage tank 112 and also to define a chamber for fan 140 as discussed in more detail below and with reference to FIG. 4.

Mounted directly above fan 140, is an air supply passage in the form of a flue 144. While the term "flue" generally refers to an exhaust conduit for combustion gases received from a combustion chamber of a fuel-fired water heater, the term "flue" herein refers to any structure capable of defining a passage for air. As described below in greater detail, a heat pump water heater according to this invention can utilize components from conventional water heaters such as a flue conventionally used to exhaust combustion gases.

Flue 144 has a bottom end 146 disposed above fan 140. Flue 144 also has a top end 148 disposed at heat pump water heater top 104. Between bottom end 146 and top end 148 is flue middle portion 150, which extends through the interior of water storage tank 122 from water storage tank base 118, past water storage tank top 114 to heat pump water heater top 104. The embodiment of FIG. 1 shows flue 144 disposed along center line C. Also, the embodiment shown in FIG. 1 optionally has a filter 152 disposed within or above flue 144 at flue top 148 to catch and retain dust, particulates, or other airborne debris.

Heat pump water heater system 100 heats water in water storage tank 112 by transferring heat from ambient air to water in water storage tank 112 by heat transfer. The flow of air according to FIG. 1 and shown by arrows E begins when air is drawn by fan 140 into flue top 148 of flue 144 above upper portion 108 of heat pump water heater system 100. After passing through filter 152, air travels down through flue middle portion 150 into lower portion 110 of the heat pump water heater system 100. In lower portion 110, the air passes through heat absorber 122, which has air passages between the fluid lines 152 (described below). Air then is exhausted from lower portion 110 by way of air passages 154 (exemplary locations shown in FIG. 1) formed in an inner jacket 190 and the outer jacket 102.

Heat is transferred when a moderate-temperature source of air passes through heat absorber 122 of heat exchange system 120. Heat exchange system 120 is a closed loop system defining passages for refrigerant fluid to flow. The refrigerant fluid being at a cold temperature after depressurization will readily absorbs heat. Thus, when the moderate-temperature air passes over heat absorber 122, the refrigerant fluid absorbs the heat. As a result, the exhausted air from lower portion 110 as described above, is cooler then the air drawn into heat pump water heater system 100.

The heated refrigerant fluid, which had absorbed the heat from the air in heat absorber 122, flows to a compressor 124. Compressor 124 may be driven by electrical energy or other suitable power source. Compressor 124 imparts pressure to the refrigerant fluid, thereby further increasing its temperature. The hot refrigerant vapor is discharged from the compressor 124 and passes into water storage tank 112 by way of a second fluid line 128. As previously discussed above, the second fluid line 128 forms coils 130.

According to the embodiment of FIG. 1, coils 128 encircle, but are spaced apart from flue 144. The multiple coils wound around, but spaced apart from, a centrally disposed flue 144, form a heat transfer region 132 in water storage tank 112. Heat transfer region 132 allows heat from the hot vapor to transfer into the water stored in water storage tank 112. When the refrigerant leaves the heat rejecter 132, a substantial amount of heat has been transferred, but the refrigerant is still largely in its vapor phase. The third fluid line 134 directs the refrigerant fluid to the expansion valve 136 where it is rapidly depressurized. The refrigerant continues to move through the lines to the heat absorber 122 by way of a fluid line 138 to absorb more heat from the moderate-temperature air.

Figure 2:
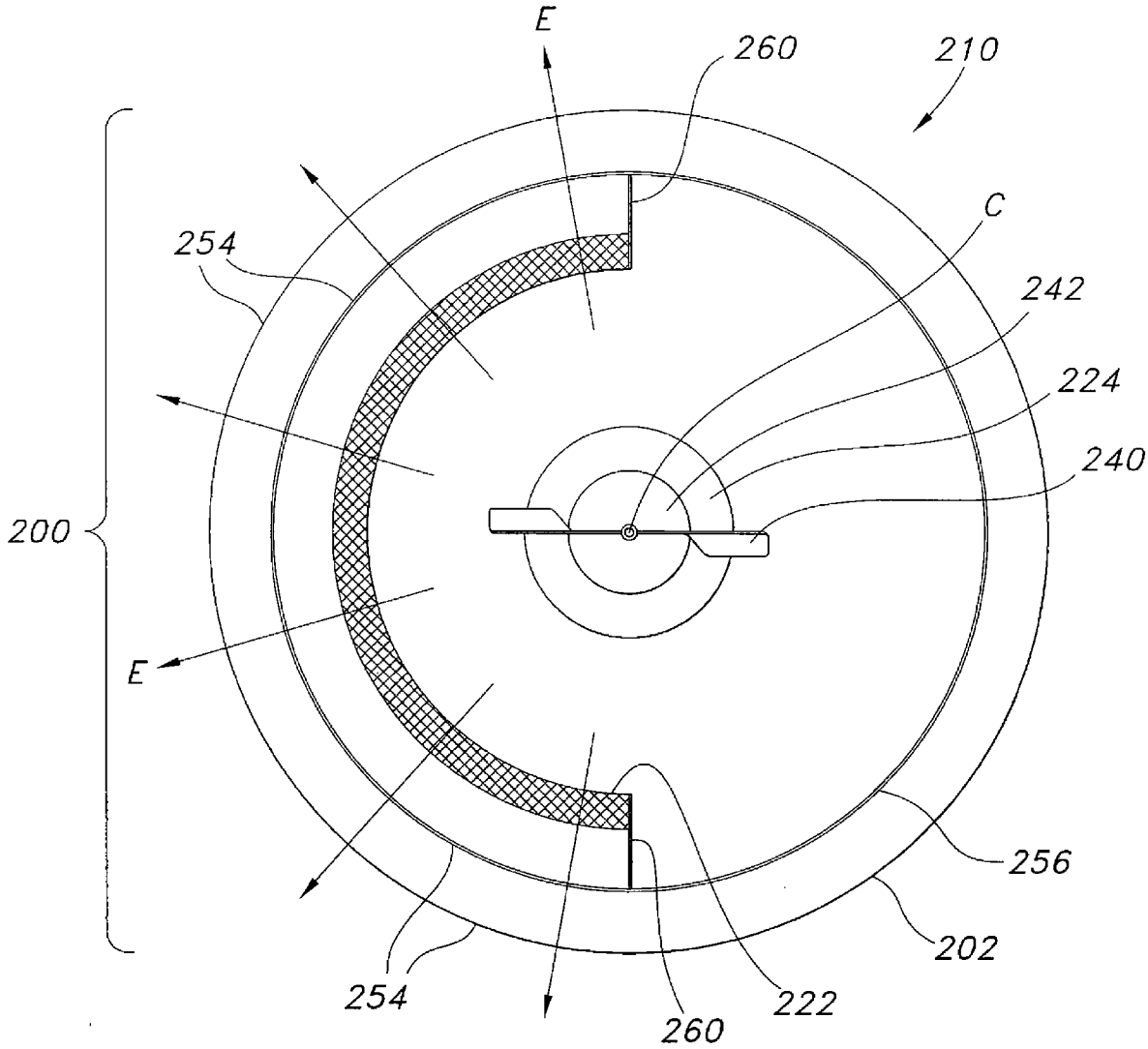
FIG. 2 is a top view of a lower portion of an exemplary heat pump water heater.

FIG. 2 is top view of lower portion 210 of an exemplary embodiment of a water heater heat pump. Lower portion 210 of the heat pump water heater shown in FIG. 2 is substantially cylindrical in shape and a cross-sectional, top view appears as a series of concentric circles. At the center of the circle is central axis C shown in FIG. 2. Moving radially outward from center axis C, is fan 240, motor 242, compressor 224, heat absorber 222, inner jacket 256, and finally outer jacket 202. As shown in the embodiment of FIG. 2, heat absorber 222 has a substantially arcuate shape, more specifically, a semi-circular shape.

Air is drawn into lower portion 210 by fan 240. The air then passes through the heat absorber 222 because the side of inner jacket 256 opposing heat absorber 222 is not permeable to air. The side of inner jacket 256 and outer jacket 202 adjacent heat absorber 222, however, is permeable to air and contains air passages 254 (exemplary locations shown in FIG. 2) to allow the air to be exhausted. The direction of air flow is illustrated with arrows E. At the intersection between the portions of inner jacket 256 containing air passages 254 and that portion of inner jacket 256 not containing air passages 254 is disposed a seal plate 260. Seal plate 260 forces ambient air to flow outwardly from inner jacket 256.

Figure 3:
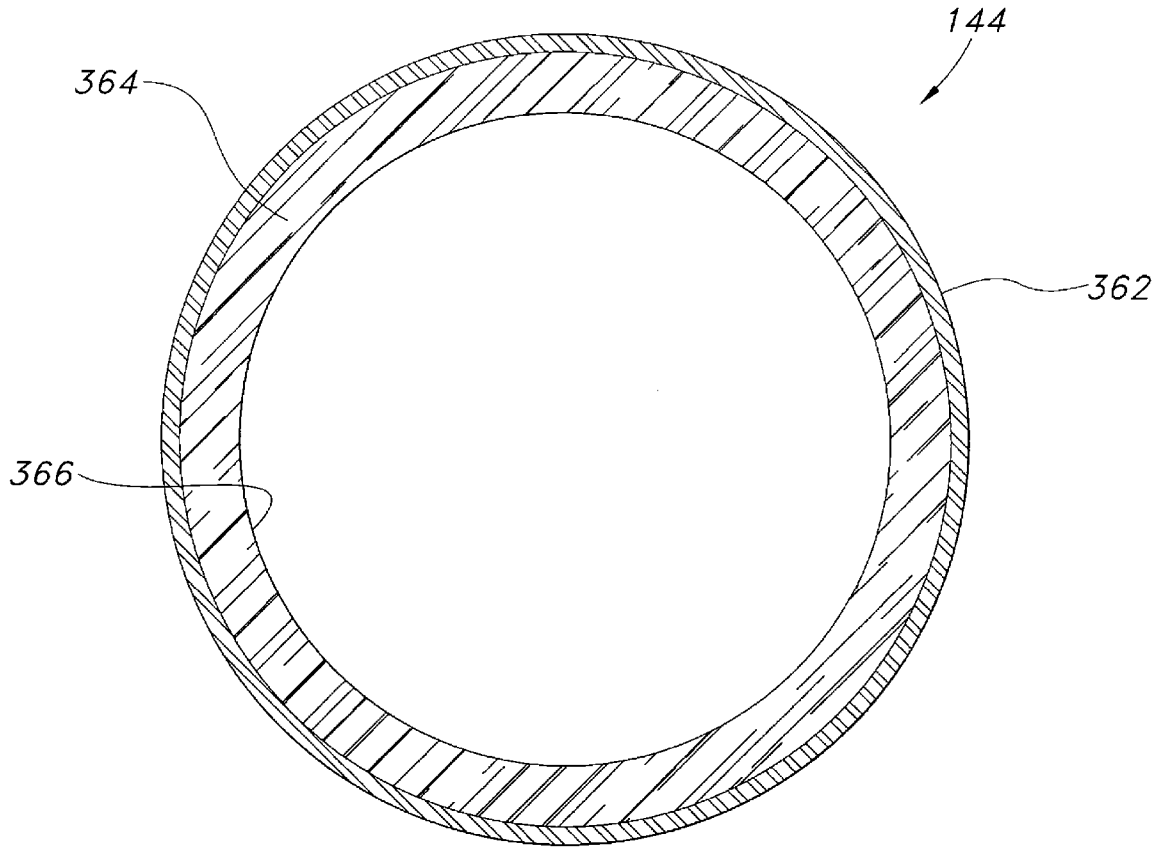
FIG. 3 is a cross-sectional view along line A-A of FIG. 1.

Water in water storage tank 112 is heated by the heat rejecter 132 of heat exchange system 120. Because flue 144 passes through a portion of water storage tank 112, it is advantageous to prevent the water in water storage tank 112 from transferring a portion of its heat to the air passing through flue 144. FIG. 3 is a view along line A-A of FIG. 1. Specifically, FIG. 3 illustrates a cross-section of another embodiment of flue 144. Along the exterior of flue 144 is a structural cylinder 362 that may be a distinct and separate piece from water storage tank 112 or structural cylinder 362 may be defined by an interior wall of water storage tank 112 (not shown in FIG. 3) and thus integral to water storage tank 112. Structural cylinder 362 may be constructed from non-corrosive plastics or metals, for example, PVC, steel, or aluminum. Disposed on the inside of structural cylinder 362 is flue insulation 364. Flue insulation 364 has an inner surface 366 that defines a smooth surface for air to travel through flue 144. The material for insulation 364 can be selected from known insulation materials.

Figure 4:
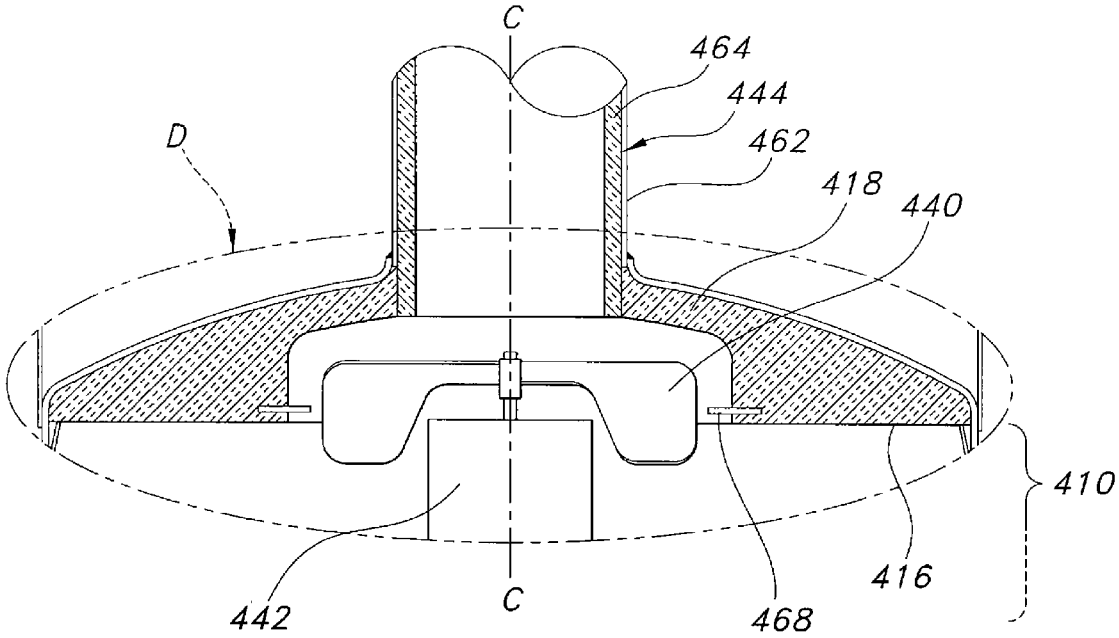
FIG. 4 is an enlarged view of Section D of FIG. 1.

FIG. 4 is an enlarged view of section D defined by dotted lines shown in FIG. 1. FIG. 4 illustrates the intersection of a flue 444 with a water storage tank base 416 and the positioning of a fan 440 over a lower portion 410. The embodiment shown in FIG. 4 illustrates flue structural cylinder 462 as an integral part of water storage tank (not shown). Similarly, flue tube insulation 464 and base insulation 418 form an insulated passage for air to travel. In the embodiment of FIG. 4, the central point of fan 440 and the center axis of flue 444 correspond to central axis C. Fan 440 is mounted on motor 442.

Along the sides of fan 440, and mounted to base insulation 418, is an orifice plate 468, which comprises an annular ring defining an opening slightly larger than the diameter of fan 440. The orifice plate 468 directs the air flow through the fan 440 while reducing reverse flow.

Figure 5:
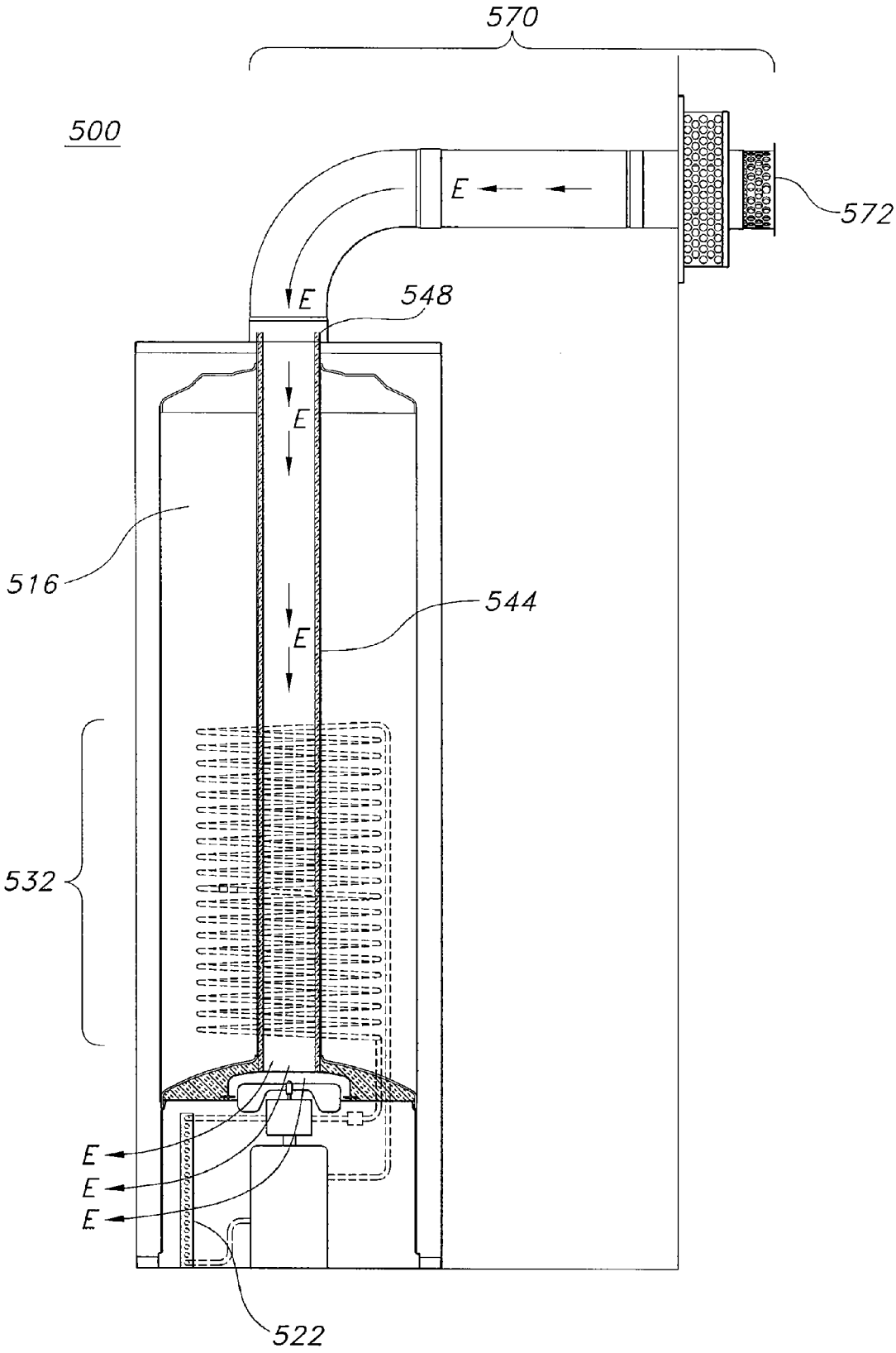
FIG. 5 illustrates a heat pump water heater having an exterior air supply according to another exemplary embodiment of the present invention.

FIG. 5 illustrates a heat pump water heater 500 according to another embodiment of the present invention. Heat pump water heater system 500 includes a flue extension 570 connected to a flue top 548. Flue extension 570 provides an air inlet 572 at one end and is connectable to flue top 548 at the other end. When system 500 is placed inside a building, for example the basement of a home, flue extension 570 extends a flue 544 such that system 500 may draw air from the exterior of the building. The flow path of the air is shown by arrows E.

One advantage of this configuration is that, during the warmer periods of time, warm outside air is drawn through system 500. Heat from the warmer, exterior air is extracted and transferred to the water in water storage tank 516. The resulting cool air is exhausted into the house. Thus, the interior of the house is cooled and dehumidified, while generating hot water. It will be recognized that such a system is especially beneficial for use in warmer climates.

Figure 6:
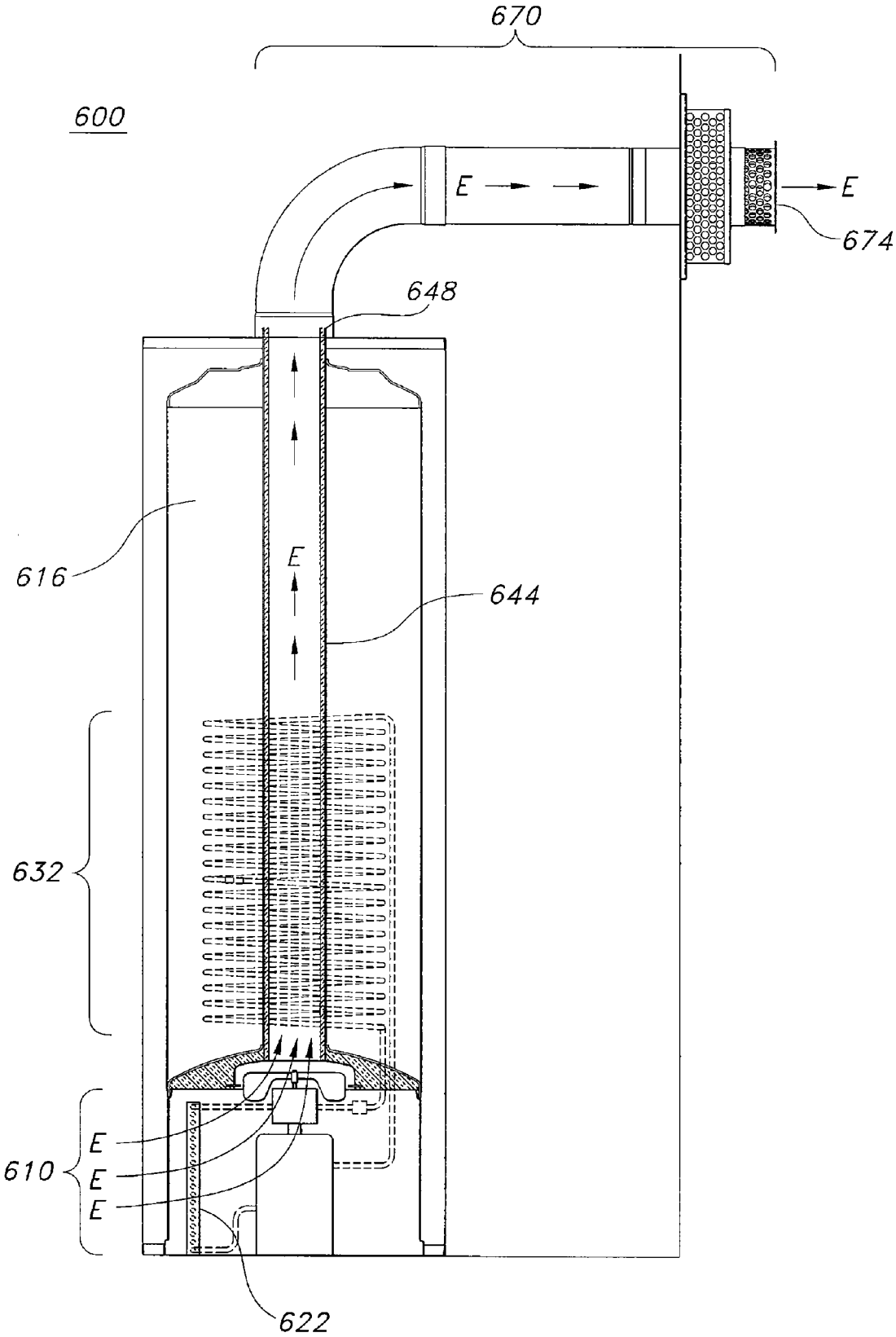
FIG. 6 illustrates a heat pump water heater having an exterior air discharge according to yet another exemplary embodiment of the present invention.

FIG. 6 illustrates a heat pump water heater 600 according to a further embodiment of the present invention. Heat pump water heater 600 differs from heat pump water heaters 100 and 500 in that it provides for air flow in the opposite direction. In other words, the air supply enters the water heater heat pump 600 at a location proximal to the heat absorber 622 as opposed to entering the water heater heat pump from above. Accordingly, water heater heat pump 600 is substantially similar in construction to water heater heat pump 500 (FIG. 5) except that the direction of air flow through the system is reversed.

Heat pump water heater system 600 includes a flue extension 670 connected to a flue top 648. Flue extension 670 contains an air discharge 674 at one end and is connectable to flue top 648 at the other end. When system 600 is placed inside a building, for example the basement of a home, flue extension 670 extends flue 644 such that system 600 may exhaust air to the exterior of the building. The flow path of the air is shown by arrows E. One advantage of this configuration is that when it is desirable to refresh the interior air, warm, stale inside air is drawn through system 600 at lower portion 610. Heat from the warmer (but stale), inside air is extracted by heat absorber 622 and transferred by the heat rejecter 632 to the water in water storage tank 616. The resulting cool air is exhausted to the exterior of the house. Thus, the heat pump water heater 600 serves the dual functions of refreshing the interior air and generating hot water.

Figure 7:
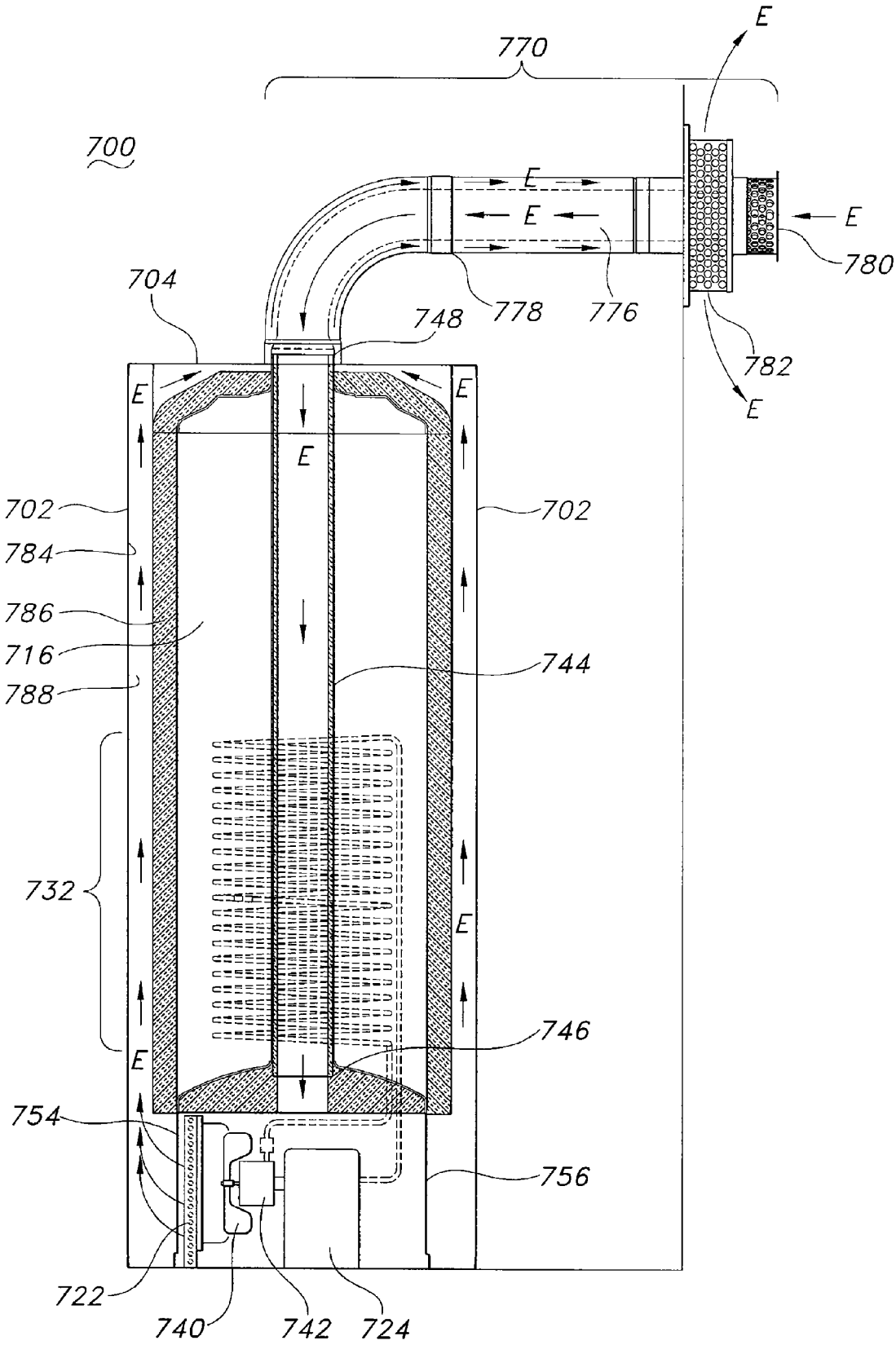
FIG. 7 illustrates a heat pump water heater having an exterior air supply and discharge according to still another exemplary embodiment of the present invention.

FIG. 7 illustrates a heat pump water heater 700 according to yet a further embodiment of the present invention where exterior air is drawn into heat pump water heater system 700 and is also exhausted to the exterior. In this embodiment, system 700 includes a flue extension 770 connected to water heater heat pump top 704. Flue extension 770 comprises concentric air passages where an air supply air passage 776 has a smaller diameter than air discharge passage 778. Specifically, air supply passage 776 is disposed within air discharge passage 778 where a cross-section of passages 776 and 778 would appear as concentric circles.

Air supply passage 776 has an air inlet end 780 disposed to the exterior and is connected to flue top 748 at the other end. In this way, heat pump water heater 700 is like heat pump water heater 500. Similarly, air discharge passage 778 has an air discharge outlet 782 disposed to the exterior and at the other end is connected to heat pump water heater top 704, but not flue to 748. As shown in the exemplary embodiment of FIG. 7, air inlet 780 is open on its end and extends beyond air discharge outlet 782, which is not open on its end, but is open along its circumference for at least a portion of its length.

In the configuration of the exemplary embodiment shown in FIG. 7, outer jacket 702 has an interior surface 784. Spaced apart from outer jacket 702 is insulation 786 to insulate water storage tank 716. Interior surface 784 of outer jacket 702 and the outer surface of insulation 786 of water storage tank 716 together define an air discharge passage 788 that is in fluid flow connection with flue extension 770 and air discharge passage 778.

Air flow according to the exemplary embodiment shown in FIG. 7 is shown by arrows E. Air is drawn into air supply passage 776 of flue extension 770 by means of air inlet 780. Air flows through air supply passage 776 and enters flue 744 at flue top 748. The air exits flue 744 at flue bottom 746. According to this exemplary embodiment, fan 740 attached to motor 742 is disposed on a side of compressor 724 that faces heat absorber 722. On the side opposite fan 740, there is disposed an air impermeable inner jacket 756. Fan 740 forces air drawn in from flue 740 over heat absorber 722. The exhaust air travels through air passages 754 (exemplary locations shown in FIG. 7) disposed within inner jacket 756 adjacent heat absorber 722 and enters air discharge passage 788.

Outer jacket 702 does not contain air passages like air passages 754. Air instead remains within the jacket 702 and travels through air discharge passage 788, enters flue extension 770 via air discharge passage 778, and is exhausted by way of air discharge outlet 782. In this configuration, air inside a home or basement or other structure is not disturbed. Only exterior air is used as a heat supply, and all exhaust air is vented to an exterior of the structure.

It has been recognized that, during the process of absorbing heat from warm air, water condensation often accumulates on the exterior surfaces of the heat absorber or other components of the circuit. Such condensation can create operational problems if it comes into contact with electronics of the heat pump water heater system. Also, it becomes necessary to dispose of such water condensation.

Therefore, a drain system is optionally incorporated into the heat pump water heater to accommodate the collection and removal of water condensation from the heat absorber. Such a drain is optionally used even when the heat absorber is positioned above the water storage tank. However, it has been discovered that the challenges associated with the drainage of water condensation can be reduced when the heat absorber is positioned beneath the water storage tank as illustrated in FIGS. 1 and 5-7.

As shown in FIGS. 1, 2, and 5-7, therefore, the lower portion of the heat pump water heater 100, 200, 500, 600, 700 houses the fan, motor, compressor, and heat absorber. A heat absorber placed in the lower portion of the heat pump water heater can therefore be maintained separate from the electronic control system of the heat pump water heater and eliminates the need for an elaborate drainage system. Moreover, because the heat absorber is housed in the lower portion, it is easier for conventional plumbing to accommodate the drainage.

It has also been recognized that, as air passes through the heat absorber, particulates (e.g., dust, dirt, lint) tend to accumulate on the exterior surfaces of the heat absorber or other components of the heat exchange circuit. Specifically, as heat absorbers absorb heat from warm air, the air condenses and particulates and dust from the air collect on the surfaces of the heat absorber. Such an accumulation can compromise the efficiency of the heat pump water heater. Also, it becomes necessary to clean the heat absorber with some frequency.

It is therefore desirable to supply air to the heat absorber that contains minimal particulates. Therefore, a filter (such as filter 152 shown in FIG. 1) is optionally incorporated into the heat pump water heater to reduce the accumulation of particulates on and around the heat absorber. Though not shown, such a filter is optionally used even when the air inlet is positioned below the water storage tank as in the embodiment of FIG. 6. However, it has been discovered that the challenges associated with the accumulation of particulates can be reduced when the air inlet is positioned above the heat absorber as illustrated in FIGS. 1, 5 and 7.

According to the exemplary embodiments of the present invention shown in FIGS. 1, 5, and 7, therefore, the air supply for the heat exchange circuit that ultimately passes over the heat absorber is drawn in from above the lower portion of the heat pump water heater. Such positioning of the air inlet separates the inlet from the floor on which the heat pump water heater sits, where particulates often reside. Specifically, the embodiment of FIG. 1 draws air from above the heat pump water heater, and the embodiments of FIGS. 5 and 7 draw air from outside of the building in which the heat pump water heater resides. By drawing air from above the lower portion, the embodiments of the present invention shown in FIGS. 1, 5, and 7 therefore supply air that does not have as much dust or particulate matter than if air were drawn in from the lower portion, closer to the heat absorber of those embodiments.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A heat pump water heater comprising:

a water storage tank;

an outer jacket surrounding the water storage tank; and a heat exchange circuit comprising a heat absorber positioned below said water storage tank and a heat transfer region in fluid communication with said heat absorber and positioned within said water storage tank to be immersed in water contained within said water storage tank, said heat absorber being configured to transfer heat to fluid in said heat exchange circuit, and said heat transfer region being configured to transfer heat from fluid in said heat exchange circuit to water in said water storage tank;

wherein said heat pump water heater defines an air supply passage upstream of said heat absorber; and wherein said air supply passage extends through an interior of said water storage tank and is positioned to be immersed in water contained within said water storage tank.

2. The heat pump water heater of claim 1, wherein said water storage tank is vertically oriented.

3. The heat pump water heater of claim 1, wherein said heat absorber has an arcuate profile.

4. The heat pump water heater of claim 3, wherein said arcuate profile of said heat absorber is semicircular.

5. The heat pump water heater of claim 1, wherein said heat exchange circuit further comprises a compressor configured to pressurize fluid in said heat exchange circuit.

6. The heat pump water heater of claim 5, wherein said compressor is positioned below said water storage tank.

7. The heat pump water heater of claim 1, wherein said heat transfer region comprises at least one coil.

8. The heat pump water heater of claim 1, wherein said heat exchange circuit further comprises an expansion valve configured to depressurize fluid in said heat exchange circuit.

9. The heat pump water heater of claim 1, wherein said air supply passage has an inlet positioned above said heat absorber.

10. The heat pump water heater of claim 9 further comprising a filter positioned to filter particulate matter from the air in said air supply passage.

11. The heat pump water heater of claim 1, wherein said heat transfer region comprises at least one coil disposed around said air supply passage.

12. The heat pump water heater of claim 1, wherein said heat pump water heater defines an air discharge passage downstream of said heat absorber.

13. The heat pump water heater of claim 12, wherein said air discharge passage has an outlet positioned above said heat absorber of said heat pump water heater.

14. A heat pump water heater comprising:

a water storage tank positioned in an upper portion of said heat pump water heater;

an outer jacket surrounding the water storage tank; and a heat exchange circuit comprising a heat absorber positioned in a lower portion of said heat pump water heater below said water storage tank and a heat transfer region in fluid communication with said heat absorber and positioned within said water storage tank to be immersed in water contained within said water storage tank;

said heat absorber being configured to transfer heat to fluid in said heat exchange circuit, and said heat transfer region being configured to transfer heat from fluid in said heat exchange circuit to water in said water storage tank;

wherein said heat pump water heater defines an air supply passage upstream of said heat absorber and having an inlet positioned above said lower portion of said heat pump water heater; and wherein said air supply passage extends through an interior of said water storage tank and is positioned to be immersed in water contained within said water storage tank.

15. A method of manufacturing a heat pump water heater comprising the steps of:

positioning a water storage tank within an upper portion of a jacket of the heat pump water heater;

positioning a heat absorber in a lower portion of the jacket below the water storage tank;

positioning an air supply passage upstream of the heat absorber and through an interior of said water storage tank, such that, in operation, the air supply passage is positioned to be immersed in water contained within the water storage tank, wherein the air supply passage is positioned to deliver supply air to the heat absorber;

positioning a heat transfer region within the water storage tank, such that, in operation, the heat transfer region is positioned to be immersed in water contained within the water storage tank; and coupling the heat absorber and heat transfer region to form a heat exchange circuit, wherein the heat absorber is configured to transfer heat to fluid in the heat exchange circuit, and the heat transfer region is configured to transfer heat from fluid in the heat exchange circuit to water in the water storage tank.

16. A heat pump water heater comprising:

a water storage tank;

an outer jacket surrounding the water storage tank; and a heat exchange circuit comprising a heat absorber, a compressor positioned below said water storage tank and being configured to pressurize fluid in said heat exchange circuit, and a heat transfer region in fluid communication with said heat absorber and positioned within said water storage tank to be immersed in water contained within said water storage tank, said heat absorber being configured to transfer heat to fluid in said heat exchange circuit, and said heat transfer region being configured to transfer heat from fluid in said heat exchange circuit to water in said water storage tank;

wherein said heat pump water heater defines an air supply passage upstream of said heat absorber; and wherein said air supply passage extends through an interior of said water storage tank and is positioned to be immersed in water contained within said water storage tank.

* * * * *